US009991045B1

(12) United States Patent
Folker et al.

(10) Patent No.: US 9,991,045 B1
(45) Date of Patent: Jun. 5, 2018

(54) BOBBIN AND CORE ASSEMBLY CONFIGURATION AND METHOD FOR E-CORE AND I-CORE COMBINATION

(71) Applicant: Universal Lighting Technologies, Inc., Madison, AL (US)

(72) Inventors: Donald Folker, Madison, AL (US); Mike LeBlanc, Huntsville, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days. days.

(21) Appl. No.: 14/923,518

(22) Filed: Oct. 27, 2015

Related U.S. Application Data

(60) Provisional application No. 62/074,736, filed on Nov. 4, 2014.

(51) Int. Cl.
*H01F 27/32* (2006.01)
*H01F 41/02* (2006.01)

(52) U.S. Cl.
CPC ..... *H01F 27/325* (2013.01); *H01F 41/0206* (2013.01)

(58) Field of Classification Search
CPC ..... H01F 27/325
See application file for complete search history.

(56) References Cited

U.S. PATENT DOCUMENTS 3,368,177 A * 2/1968 Hilgers ..... H01F 27/306 336/198
4,887,061 A * 12/1989 Matsumura ..... H01F 38/42 336/198
4,931,761 A * 6/1990 Kijima ..... H01F 27/266 336/198
6,294,975 B1 * 9/2001 Chen ..... H01F 27/325 336/198
2001/0035807 A1 * 11/2001 Chiang ..... H01F 27/325 336/182
2003/0080844 A1 * 5/2003 Nishikawa ..... H01F 27/306 336/178
2003/0210120 A1 * 11/2003 Sigl ..... H01F 27/325 336/198
2004/0008102 A1 * 1/2004 Nakazaki ..... H01F 5/02 336/65
2004/0036568 A1 * 2/2004 Suzuki ..... H01F 27/325 336/192

(Continued)

*Primary Examiner* — Elvin G Enad
*Assistant Examiner* — Malcolm Barnes
(74) *Attorney, Agent, or Firm* — Patterson Intellectual Property Law, P.C.; Gary L. Montle; Jerry Turner Sewell

(57) ABSTRACT

A magnetic assembly includes a bobbin having at least first and second end flanges. The bobbin includes a channel wall displaced from the first end flange to from a channel therebetween. The channel receives and frictionally engages an I-core to retain the I-core in the channel. The bobbin includes a passageway that receives a middle leg of an E-core. The passageway includes a plurality of longitudinal ribs that extend from the first end flange toward the second end flange. The ribs are tapered with respect to the inner wall of the passageway. The middle leg of the E-core crushes the ribs. The frictional engagement of the crushed ribs with the middle leg retains the middle leg in the passageway. No taping, gluing or other additional step is required to assemble the bobbin and the two cores.

13 Claims, 13 Drawing Sheets

(56) References Cited

U.S. PATENT DOCUMENTS

| | | | | |
|---|---|---|---|---|
| 2004/0075524 | A1* | 4/2004 | Nagai | H01F 27/325 336/208 |
| 2004/0125628 | A1* | 7/2004 | Yamada | H01F 27/325 363/177 |
| 2005/0104703 | A1* | 5/2005 | Watanabe | H01F 3/14 336/83 |
| 2009/0066459 | A1* | 3/2009 | Chih | H01F 27/325 336/198 |
| 2009/0151153 | A1* | 6/2009 | Liu | H01F 27/29 29/605 |
| 2010/0321958 | A1* | 12/2010 | Brinlee | H01F 3/14 363/21.1 |
| 2016/0049238 | A1* | 2/2016 | Young | H01F 3/14 336/172 |
| 2017/0025211 | A1* | 1/2017 | Buhler | H01F 5/02 |

* cited by examiner

BOBBIN AND CORE ASSEMBLY CONFIGURATION AND METHOD FOR E-CORE AND I-CORE COMBINATION

CROSS-REFERENCES TO RELATED APPLICATIONS

This application claims benefit of the following patent application which is hereby incorporated by reference: U.S. Provisional Patent Application No. 62/074,736 filed Nov. 4, 2014, entitled "Bobbin and Core Assembly Configuration and Method for a Magnetic Component."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Currently, the cores on magnetic assemblies having a combination of an extended E-core and an I-core are held together with tape or glue. The two cores must be held in place during assembly until the tape is secured or until the glue is dried. Adding tape or glue to restrain the cores requires additional steps during an assembly process and adds cost to the manufacturing process. Accordingly, a need exists for a low-cost bobbin and core assembly method for a combination of an E-core and an I-core that does not require taping or gluing the cores together.

BRIEF SUMMARY OF THE INVENTION

The new bobbin and core assembly method uses only the bobbin to secure the cores together. The bobbin includes a first end flange and a second end flange spaced apart from each other to receive a winding therebetween. A channel wall is displaced away from the first end flange to form an I-core receiving channel between an outer surface of the first end flange and an inner surface of the channel wall. The bobbin includes a passageway extending from the first end flange to the second end flange to receive the middle leg of an E-core. The passageway and the middle leg may be rectangular (e.g., square), round, oval, or another suitable shape. The passageway includes a plurality of crushable passageway ribs that extend at least partially from the second end flange toward the first end flange. The middle leg is inserted into the passageway from the second end flange and crushes the passageway ribs to cause the middle leg to be frictionally engaged with the passageway ribs and thereby retained in the passageway with an end surface of the middle leg positioned proximate to the first end flange and a selected distance from the outer surface of the first end flange. An I-core is inserted into the I-core receiving channel with a first facing surface abutting the end surfaces of the outer legs of the E-core and in frictional engagement with an outer surface of the first end flange. The first facing surface of the I-core is spaced apart from the end surface of the middle leg of the E-core by the selected distance to form a magnetic gap. The friction of the first facing surface of the I-core against the first end flange and the friction of a parallel second facing surface of the I-core against the inner surface of the channel wall retain the I-core in a fixed spatial relationship with the outer legs and with the middle leg of the E-core. The labor required to assemble the magnetic component is reduced, and no tape or glue is required. The structure and the method of assembly require less material and labor to secure the two cores in the fixed spatial relationship. Accordingly, labor and material costs are reduced.

An aspect in accordance with embodiments of the present invention is a magnetic assembly comprising a bobbin, which has a first end flange and a second end flange. Each end flange has a respective outer surface. A passageway extends through the bobbin from the first end flange to the second end flange. The passageway includes a plurality of crushable passageway ribs extending longitudinally from the first end flange toward the second end flange. At least one winding is wound about the passageway. The bobbin further comprises a channel wall parallel to the outer surface of the first end flange. The channel wall has an inner surface. The inner surface of the channel wall is displaced from the outer surface of the first end flange by a distance that defines a channel between the outer surface of the first end flange and the inner surface of the channel wall. The magnetic assembly further includes an E-core. The E-core has a main body and has a first outer leg, a second outer leg, and a middle leg extending from the main body. The middle leg has an end surface. The middle leg of the E-core is positioned in the passageway of the bobbin with at least a portion of the middle leg in crushing frictional engagement with the passageway ribs. The magnetic assembly further comprises an I-core. The I-core has a first longitudinal surface and a second longitudinal surface. The two longitudinal surfaces define a thickness of the I-core therebetween. The I-core is positioned in the I-core receiving channel with the first longitudinal surface in frictional engagement with the outer surface of the first end flange and with the second longitudinal surface in frictional engagement with the inner surface of the channel wall. In certain embodiments of the magnetic assembly, each passageway rib has a first thickness at a first end proximate to the first end flange and has a second thickness at a second end displaced away from the first end flange. The second thickness is less than the first thickness. The crushable rib has an engagement surface between the first end and the second end, which frictionally engages the middle leg of the E-core. In certain embodiments of the magnetic assembly, the passageway of the bobbin has a cross-sectional profile defined by at least one inner dimension; and the middle leg of the E-core has a profile defined by at least one outer dimension. The at least one outer dimension is smaller than the at least one inner dimension by a selected magnitude so that the middle leg fits within the passageway. At least a portion of each passageway rib extends into the passageway by a distance greater than the selected magnitude so that the middle leg of the E-core engages and crushes the at least a portion of each passageway rib. In certain embodiments of the magnetic assembly, each crushable rib tapers from a first height at a first end proximate to the first end flange to a second height at a second end displaced away from the first end flange. The first height is greater than the selected magnitude; and the second height less than the selected magnitude. In certain embodiments of the magnetic assembly, the passageway of the bobbin has a rectangular cross-sectional profile having four sides, and the middle leg of the E-core has a rectangular cross-sectional profile. In such embodiments, the plurality of crushable passageway ribs comprises four ribs, with one rib extending into the passageway from each side of the passageway. In certain embodiments of the magnetic assembly, the passageway of the bobbin has a circular cross-sectional profile; and the middle leg of the E-core has a circular rectangular profile. In such embodiments, the plurality of crushable passageway ribs comprises three ribs, with the ribs positioned 120 degrees apart around the inside surface of the passageway. In certain embodiments of the magnetic assembly, the middle leg of the E-core is shorter than the two outer legs of the E-core by a selected distance. Each of the outer legs has a respective end surface. In such embodiments, the end surfaces of the outer leg abut the first longitudinal surface of the I-core such that the end surface of the middle leg is spaced apart from the first longitudinal surface of the I-core by the selected distance to form a magnetic gap between the middle leg and the I-core.

Another aspect in accordance with embodiments of the present invention is a bobbin for a magnetic assembly. The bobbin includes a first end flange and a second end flange. A passageway extends through the bobbin from the first end flange to the second end flange. The passageway includes a plurality of crushable passageway ribs extending from the first end flange toward the second end flange. At least one winding is wound about the passageway. A channel wall is parallel to the outer surface of the first end flange. The channel wall has an inner surface. The inner surface of the channel wall is displaced from the outer surface of the first end flange by a distance that defines a channel between the outer surface of the first end flange and the inner surface of the channel wall. In certain embodiments of the bobbin, each crushable rib tapers from a first height at a first end proximate to the first end flange to a second height at a second end displaced away from the first end flange.

Another aspect in accordance with embodiments of the present invention is a method of assembling a magnetic assembly. The method comprises positioning the middle leg of an E-core into a passageway of a bobbin with a first outer leg of the E-core positioned on a first side of the bobbin, with a second outer leg of the E-core positioned on a second side of the bobbin, and with a main body of the E-core positioned on a terminal rail at a first end of the bobbin. The middle leg of the E-core crushes and frictionally engages a plurality of crushable ribs extending longitudinally within the passage to secure the middle leg in the passageway. The method further comprises positioning an I-core into an I-core receiving channel at a second end of the bobbin. The I-core receiving channel has parallel inside surfaces that frictionally engage parallel side surfaces of the I-core to secure the I-core in the I-core receiving channel in a fixed relationship with the legs of the E-core. In certain embodiments of the method, one of the side surfaces of the I-core is spaced apart from an end of the middle leg of the E-core to form a magnetic gap.

Another aspect in accordance with embodiments of the present invention is a magnetic assembly. The magnetic assembly includes a bobbin having at least first and second end flanges. The bobbin includes a channel wall displaced from the first end flange to from a channel therebetween. The channel receives and frictionally engages an I-core to retain the I-core in the channel. The bobbin includes a passageway that receives a middle leg of an E-core. The passageway includes a plurality of longitudinal ribs that extend from the first end flange toward the second end flange. The ribs are tapered with respect to the inner wall of the passageway. The middle leg of the E-core crushes the ribs. The frictional engagement of the crushed ribs with the middle leg retains the middle leg in the passageway. No taping, gluing or other additional step is required to assemble the bobbin and the two cores.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Figure 1:
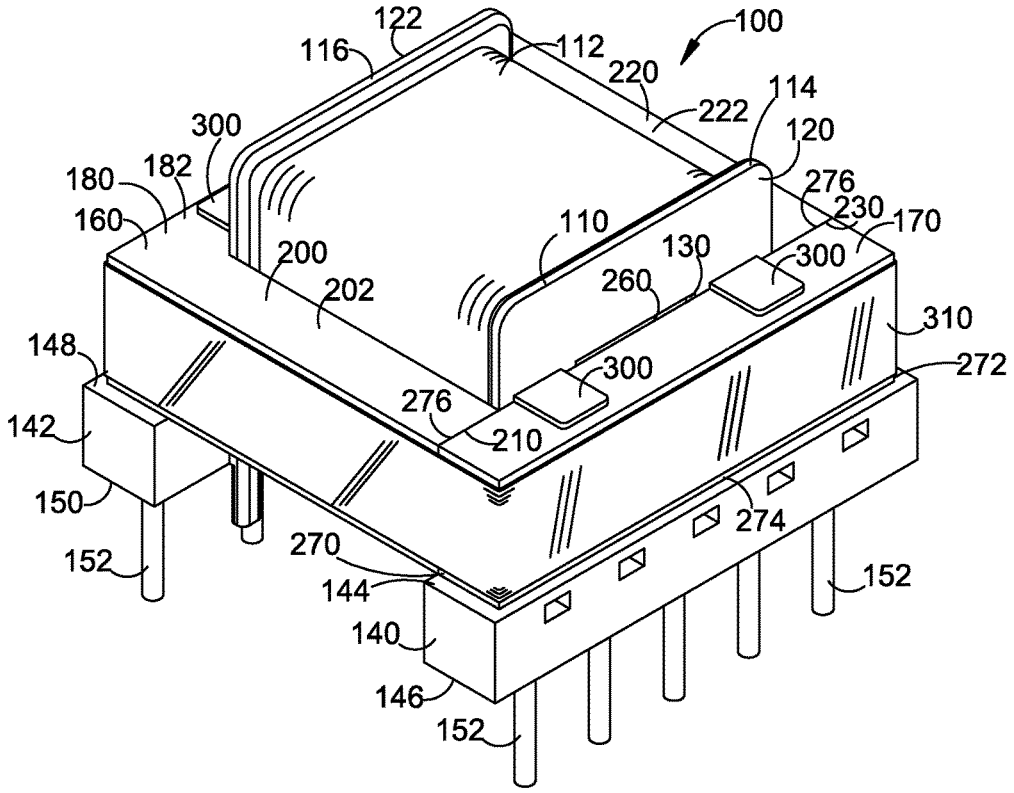
FIG. 1 (Prior Art)
FIG. 1 illustrates a perspective view of a conventional magnetic assembly comprising a bobbin, an I-core positioned across the entrance to the passageway at the first end flange, and an E-core.

FIG. 1 illustrates a perspective view of a conventional magnetic assembly 100. The magnetic assembly comprises a bobbin 110 with at least one coil 112 wound around the bobbin between a first end flange 114 and a second end flange 116. The first end flange has an outer surface 120. The second end flange has an outer surface 122. A passageway 130 extends through the bobbin from the outer surface of the first end flange to the outer surface of the second end flange. In the illustrated embodiment, the passageway has a rectangular profile. The passageway has a lower surface 132, an upper surface 134, a first side surface 136 and a second side surface 138.

The bobbin 110 includes a first connector rail 140 that extends outward from the first end flange 114 and includes a second connector rail 142 that extends outward from the second end flange 116. The first connector rail has an upper surface 144 and has a lower surface 146. The second connector rail has an upper surface 148 and a lower surface 150. In the illustrated embodiment, the upper surfaces of the connector rails are coplanar with the lower surface 132 of the passageway 130. Each connector rail includes a plurality of connector pins (contacts) 152 that are supported by the respective connector rail. At least two of the connector pins are connected by wires or other electrical conductors to the at least one winding. The connector pins are used to electrically connect the magnetic assembly to a printed circuit board or other electronic circuitry (not shown) in a conventional manner.

The magnetic assembly 100 further includes an E-core 160 positioned with respect to the second end flange 116, and includes an I-core (or I-bar) 170 positioned with respect to the first end flange 114.

Figure 2:
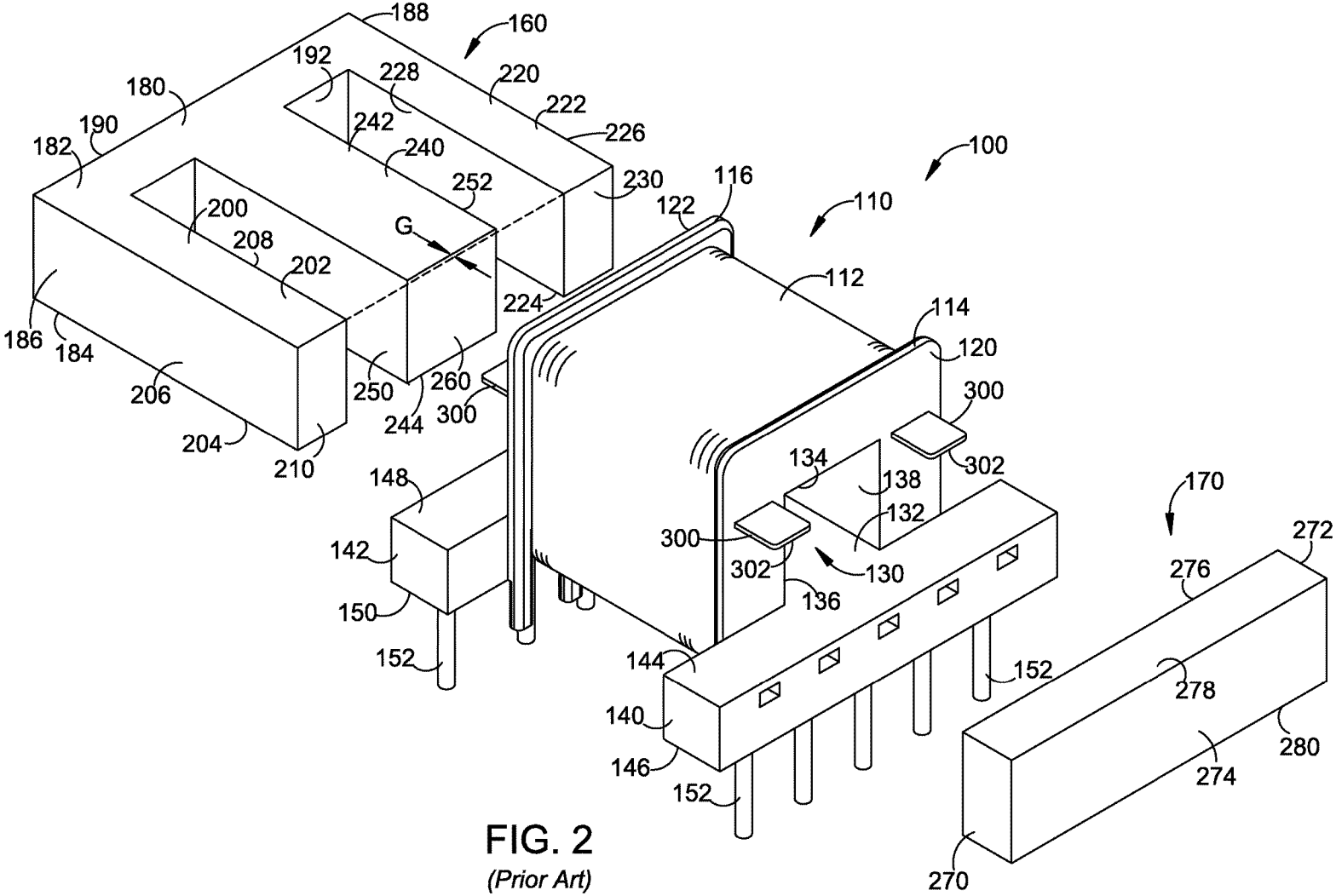
FIG. 2 (Prior Art)
FIG. 2 illustrates an exploded perspective view of the conventional magnetic assembly of FIG. 1.
Figure 4:
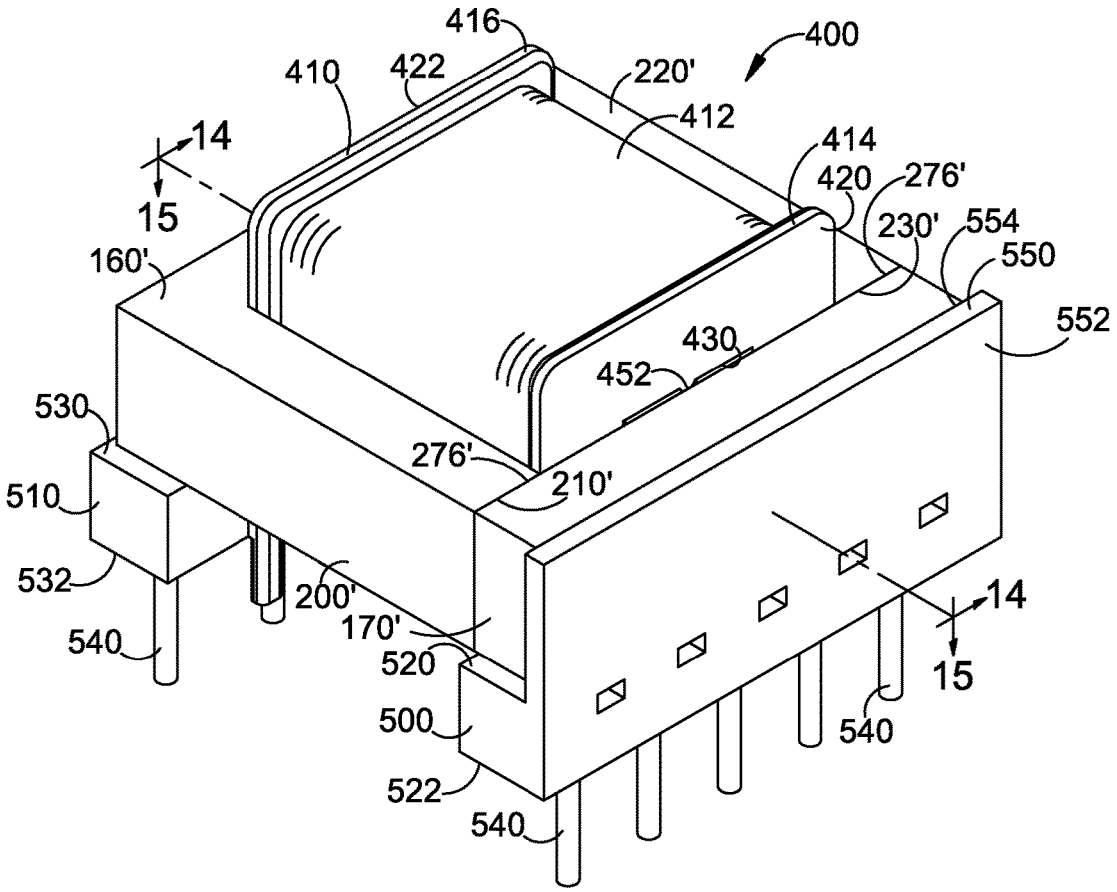
FIG. 4 illustrates a perspective view of a magnetic assembly that incorporates a modified bobbin that secures the E-core with a plurality of crushable longitudinal passageway ribs and that secures the I-core in an I-core receiving channel.
Figure 5:
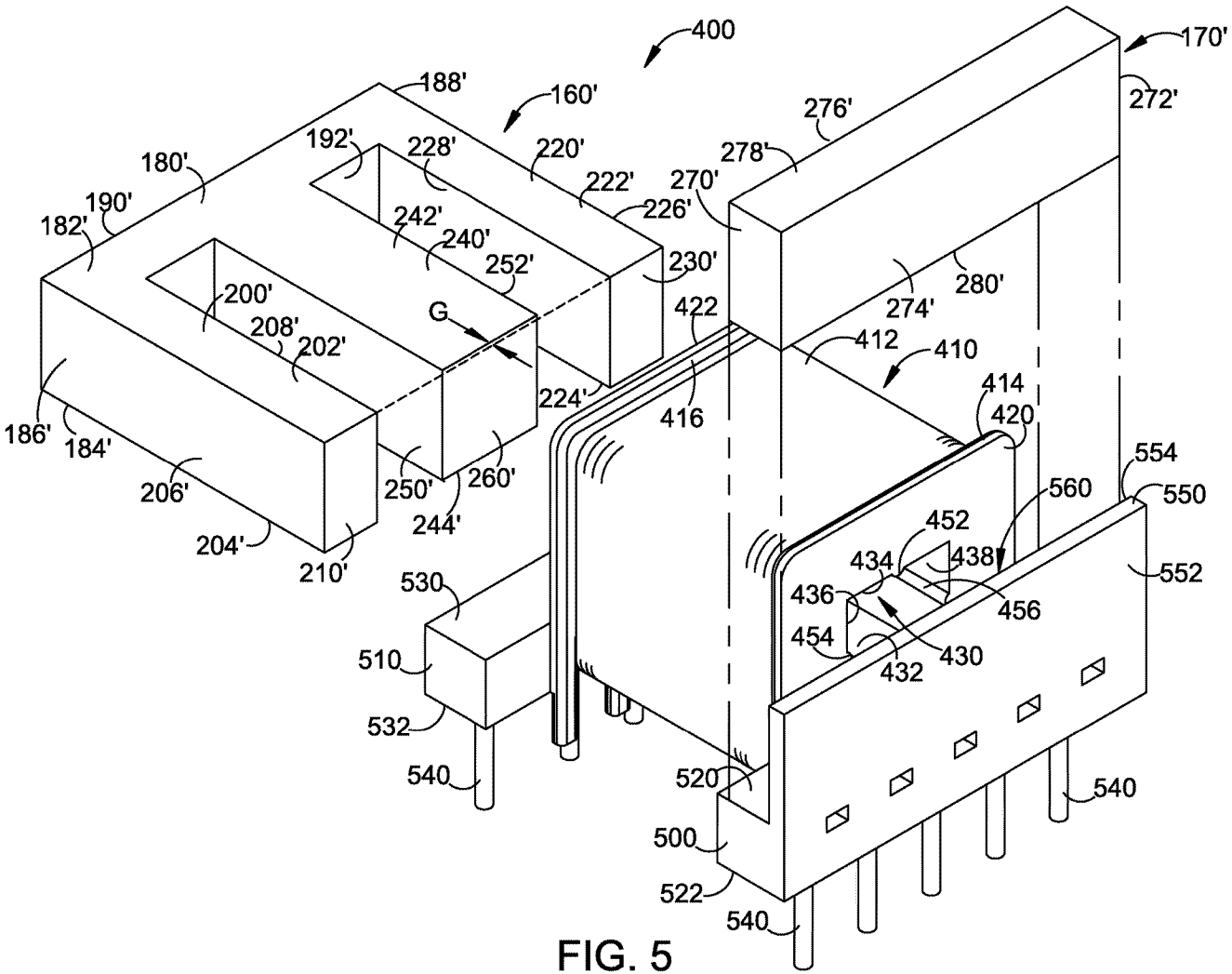
FIG. 5 illustrates an exploded perspective view of a magnetic assembly that incorporates that magnetic assembly of FIG. 4 showing the E-core prior to insertion into the passageway of the bobbin and showing the I-core prior to insertion into the I-core receiving channel.
Figure 6:
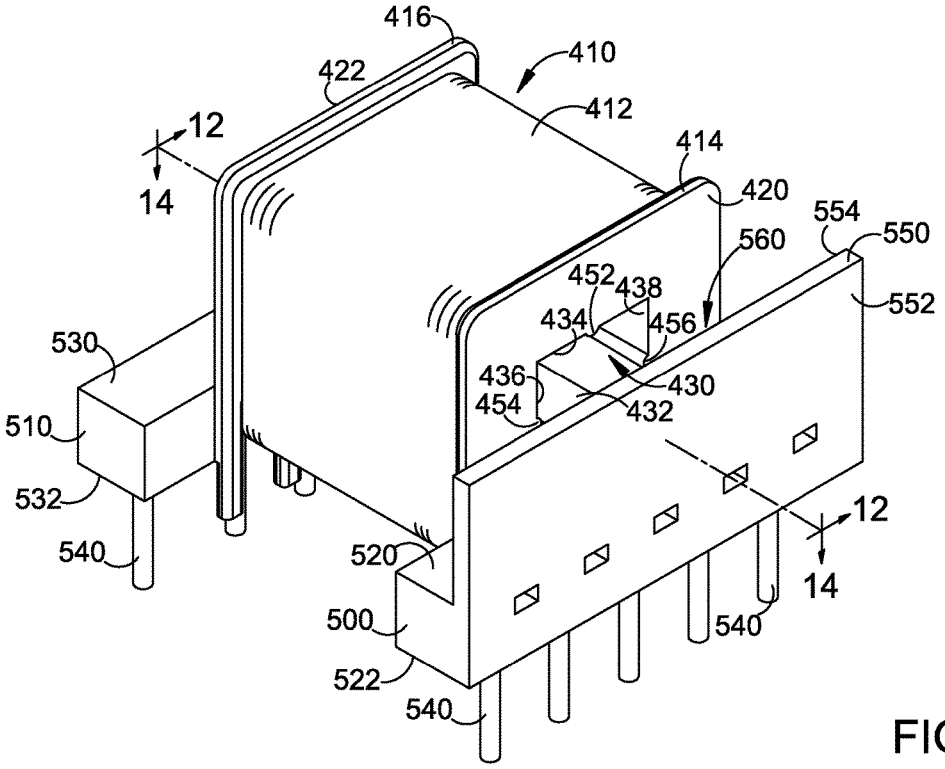
FIG. 6 illustrates a front perspective view of an embodiment of the bobbin of FIGS. 4 and 5.
Figure 7:
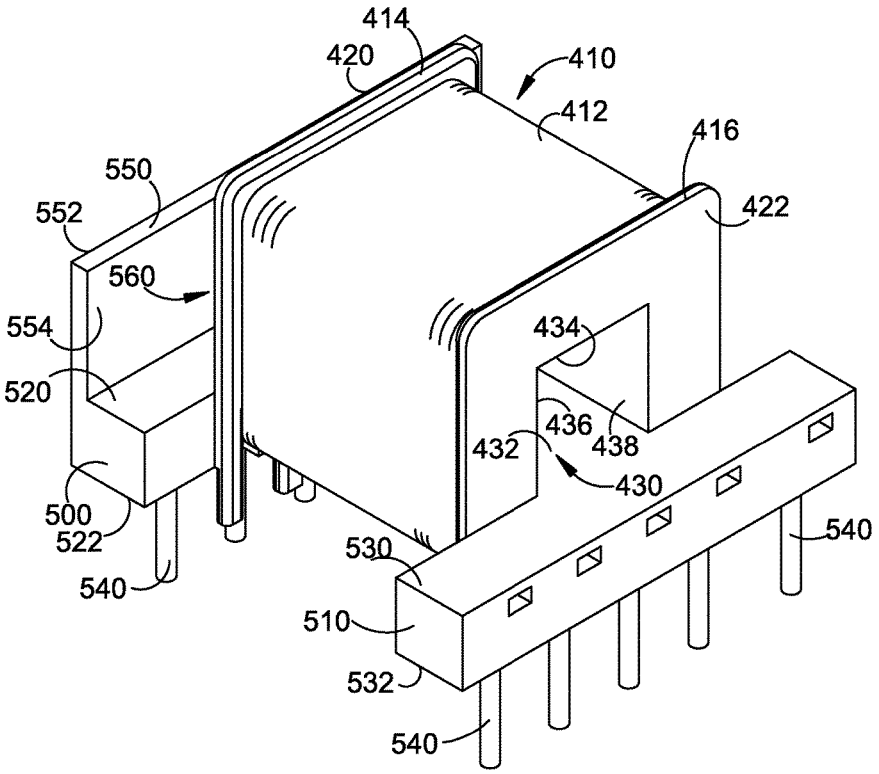
FIG. 7 illustrates a rear perspective view of the bobbin of FIG. 6.

As shown in FIG. 2, the E-core 160 comprises a body portion 180 in the form of a rectangular parallelepiped. The body portion of the E-core has an upper surface 182, a lower surface 184, a first end surface 186, a second end surface 188, an outer surface 190 and an inner surface 192. The body portion of the E-core has a width between the first end surface and the second end surface, has a height between the lower surface and the upper surface, and has a thickness between the outer surface and the inner surface.

The E-core 150 has a first outer leg 200, which extends from the inner surface 192 of the body portion 180. The first outer leg has an upper surface 202, which is coplanar with the upper surface 182 of the body portion. The first outer leg has a lower surface 204 coplanar with the lower surface 184 of the body portion. The first outer leg has an outer surface 206, which is a continuation of the first end surface 186 of the body portion. The first outer leg has an inner surface 208, which is spaced apart from the outer surface by a first outer leg thickness. The first outer leg has an end surface 210, which is parallel to and spaced apart from the inner surface of the body portion by a first outer leg length.

The E-core 160 has a second outer leg 220, which also extends from the inner surface 192 of the body portion 180, and which is parallel to the first outer leg 200. The second outer leg has an upper surface 222, which is coplanar with the upper surface 182 of the body portion and is also coplanar with the upper surface 202 of the first outer leg. The second outer leg has a lower surface 224, which is coplanar with the lower surface 184 of the body portion and is also coplanar with the lower surface 204 of the first outer leg. The second outer leg has an outer surface 226, which is a continuation of the second end surface 188 of the body portion. The first outer leg has an inner surface 228, which is spaced apart from the outer surface by a second outer leg thickness. In the illustrated embodiment, the first outer leg thickness and the second outer leg thickness are the same or substantially the same. The first outer leg has an end surface 230, which is parallel to and spaced apart from the inner surface of the body portion by a second outer leg length. In the illustrated embodiment, the first outer leg length and the second outer leg length are the same or substantially the same.

In the illustrated embodiment, the inner surface 208 of the second outer leg 200 is spaced apart from the inner surface 228 of the first outer leg 220 by a width that is as wide or is slightly wider than the width of each of the first outer flange 114 and the second outer flange 116.

The E-core 160 further includes a middle leg 240, which extends from the inner surface 192 of the body portion 180 of the E-core at a location approximately midway between the first outer leg 200 and the second outer leg 220. The middle leg has an upper surface 242 and a lower surface 244. In the illustrated embodiment, the middle leg has a height between the upper surface and the lower surface that is substantially the same as the respective heights of the body portion and the first and second outer legs between respective upper surfaces and lower surfaces. In alternative embodiments, the middle leg may have a shorter height for use with low-profile bobbins.

The middle leg 240 has a first side surface 250 and a second side surface 252. The middle leg has an end surface 260. The middle leg has a length between the inner surface 192 of the body portion 180 and the end surface. The length of the middle leg is selected to be shorter than the lengths of the outer legs by a selected distance (G), which is selected in accordance with a desired gap distance, as discussed below.

As further shown in FIG. 2, the I-core (or I-bar) 170 is formed as a rectangular parallelepiped having a width between a first end surface 270 and a second end surface 272; has a thickness between an outer surface 274 and an inner surface 276; and has a height between an upper surface 278 and a lower surface 280. In the illustrated embodiment, the width, thickness and height of the I-core are the same or approximately the same as the width, thickness and height of the body portion 180 of the E-core 160; however, one or more of the dimensions of the I-core may differ from the corresponding dimensions of the body portion of the E-core.

To form the assembly 100 of FIG. 1, the middle leg 240 of the E-core 160 is inserted into the passageway 130 at the second end flange 116. The middle leg is inserted into the passageway such that the inner surface 192 of the body portion 180 of the E-core is abutting the outer surface 122 of the second end flange. In this position, the end surface 260 of the middle leg is positioned proximate to the first end flange 114 with the end surface of the middle leg displaced by the distance (G) from the outer surface 120 of the first end flange. The width and the height of the middle leg are selected in accordance with the width and the height of the passageway such that the middle leg fits within the passageway with the respective longitudinal surfaces of the middle leg adjacent to the surfaces of the passageway. The dimensions of the middle leg are selected so that the middle leg fits snugly within the passageway with sufficient tolerances on the dimensions such that substantially no binding occurs during the insertion process. In the illustrated embodiment, the lower surface 184 of the body portion 180 of the E-core rests on the upper surface 148 of the second connector rail 142.

The I-core (or I-bar) 170 is positioned proximate to the first end flange 114 with the inner surface 276 of the I-core abutting the outer surface 120 of the first end flange. The inner surface of the I-core also abuts the end surface 210 of the first outer leg 200 of the E-core 160 and also abuts the end surface 230 of the second outer leg 220 of the E-core. Accordingly, the inner surface of the I-core is spaced apart from the end surface 260 of the middle leg 240 of the E-core 160 by the gap distance (G). The gap controls saturation of the core in a known manner and is selected to provide desired magnetization characteristics for the combination of the E-core and the I-core.

The lower surface 280 of the I-core 170 rests on the upper surface 144 of the first connector rail 140 such that the lower surface of the I-core is coplanar with the lower surface 184 of the body portion 180 of the E-core 160 and is also coplanar with the lower surfaces 204, 224 of the outer legs 200, 210 of the E-core. In the illustrated embodiment, the upper surface 278 of the I-core is coplanar with the upper surface 182 of the body portion of the E-core and with the upper surfaces 202, 222 of the outer legs of the E-cores. In the illustrated embodiment where the height of the middle leg 240 of the E-core is the same as the height of each outer leg of the E-core, the upper surface 242 of the middle leg is coplanar with the other upper surfaces and the lower surface 244 of the middle leg is coplanar with the other lower surfaces. In other embodiments, either or both of the upper surface and the lower surface of the middle leg may not be coplanar with the corresponding surfaces of the outer legs of the E-core and the corresponding surfaces of the I-core.

In the illustrated embodiment, each of the first end flange 114 and the second end flange 116 of the bobbin 110 includes a plurality of tabs 300. The tabs extend perpendicularly from the respective flange. Each tab has a respective lower surface 302. The lower surface of each tab is spaced apart from the respective upper surfaces 144, 148 of the connector rails 140, 142 at the respective end of the bobbin by a distance selected to be substantially equal to the height of the body portion 180 of the E-core 160 and the height of the I-core 170. Thus, when the magnetic assembly is assembled as shown in FIG. 1, the body portion of the E-core fits between the lower surfaces of the tabs and the upper surface of the second connector rail proximate to the second end flange. The I-core fits between the lower surfaces of the tabs and the upper surface of the first connector rail proximate to the first end flange.

Although the E-core 160 and the I-core 170 are constrained vertically between the tabs 300 and the upper surfaces 144, 146 of the connector rails 140, 142, the two cores are not constrained horizontally. Thus, the magnetic assembly 100 of FIGS. 1-3 further includes at least one layer of an adhesive tape 310, which is wrapped around the body portion 180 and the outer legs 200, 220 of the E-core and around the first end surface 270, the outside surface 274 and the second end surface 272 of the I-core after the two cores are positioned as shown in FIG. 1. Preferably, multiple layers of the adhesive tape are wound around the two cores. Alternatively, the end surfaces 210, 230 of the outer legs of the E-core are glued to the inner surface 276 of the I-core, and the two cores are held securely together until the glue sets to permanently engage the glued surfaces. In some embodiments, the lower surface and the upper surface of the body portion of the E-core and the lower surface and upper surface of the I-core may be taped or glued to the connector rails and to the tabs, respectively, to further secure the cores. In either case, the additional steps of taping or gluing require time and effort and require additional materials. The additional steps and material increase the cost of producing the magnetic assembly 100.

FIGS. 4-15 are directed to a magnetic assembly 400 having a modified bobbin 410 that reduces the time, effort and materials for producing a magnetic assembly by fixedly positioning a modified E-core 160' and an I-core 170' with respect to the bobbin without requiring taping, gluing or other post-positioning securing steps to secure the E-core 160' and the I-core 170' to the bobbin.

The I-core 170' in FIGS. 4-15 corresponds to the previously described I-core 170; and the features of the I-core 170' are identified with the element numbers as before, wherein each element number includes a prime (') at the end of the number. In particular, the I-core 170' includes a first end surface 270' and a second end surface 272', an outer surface 274' and an inner surface 276'; and an upper surface 278' and a lower surface 280', which are described above with respect to the corresponding surfaces of the I-core 170.

The E-core 160' in FIGS. 4-15 generally corresponds to the previously described E-core 160 except that the E-core 160' has a height slightly less than the previously describe E-core 160 for reasons discussed below. The features of the modified E-core 160' are identified with the element numbers as before, wherein each element number includes a prime (') at the end of the number. In particular, the modified E-core 160' includes a body portion a body portion 180' having an upper surface 182', a lower surface 184', a first end surface 186', a second end surface 188', an outer surface 190' and an inner surface 192'. The modified E-core 160' includes a first outer leg 200'. The first outer leg has an upper surface 202', a lower surface 204', an outer surface 206', an inner surface 208', and an end surface 210'. The modified E-core 160' has a second outer leg 220'. The second outer leg has an upper surface 222', a lower surface 224', an outer surface 226', an inner surface 228', and an end surface 230'. The modified E core 160' further includes a middle leg 240'. The middle leg has an upper surface 242', a lower surface 244', a first side surface 250', a second side surface 252', and an end surface 260'. The length of the middle leg is selected to be shorter than the lengths of the outer legs by the selected distance (G).

The bobbin 410 includes at least one coil 412 wound around the bobbin between a first end flange 414 and a second end flange 416. The first end flange has an outer surface 420. The second end flange has an outer surface 422. A passageway 430 extends through the bobbin from the outer surface of the first end flange to the outer surface of the second end flange. In the illustrated embodiment, the passageway has a rectangular profile. The passageway has a lower surface 432, an upper surface 434, a first side surface 436 and a second side surface 438. In the illustrated embodiment, the bobbin comprises nylon, such as, for example, commercially available Nylon 6/6 (also known as Nylon 66, Nylon 6-6 or Nylon 6,6).

Figure 8:
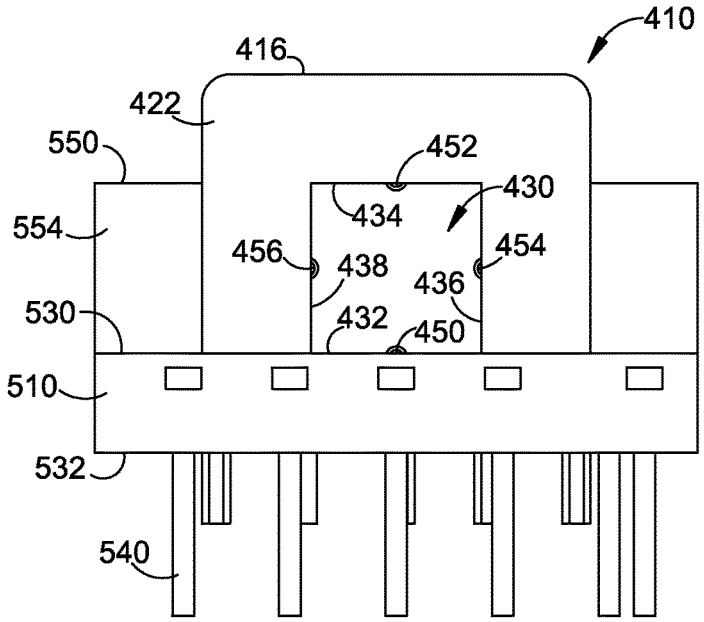
FIG. 8 illustrates a rear elevational view of the bobbin of FIG. 6 showing the arrangement of the passageway ribs.

The passageway 430 further includes a plurality of crushable ribs that extend longitudinally from the outer surface 420 of the first end flange 414 toward the second end flange 416. As shown in FIG. 8, a first rib 450 extends upwardly from the lower surface 432 of the passageway, a second rib 452 extends downwardly from the upper surface 434 of the passageway, a third rib 454 extends inwardly from the first side surface 436, and a fourth rib 456 extends inwardly from the second side surface 438. The first (lower) rib is shown in an enlarged elevational side view in FIG. 9 and in enlarged end views in FIGS. 10 and 11.

Figure 9:
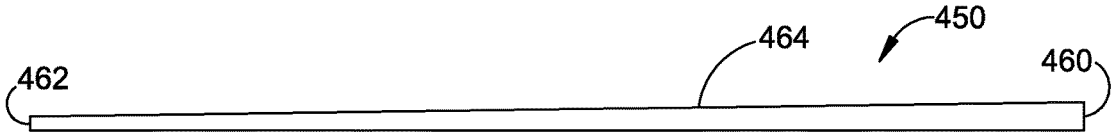
FIG. 9 illustrates an enlarged side elevational view of the lowermost passageway rib of FIG. 8.
Figure 11:
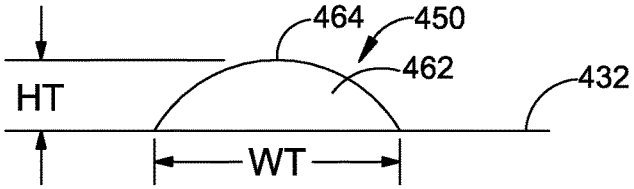
FIG. 11 illustrates an end elevational view of the terminal end of the passageway rib of FIG. 9.
Figure 12:
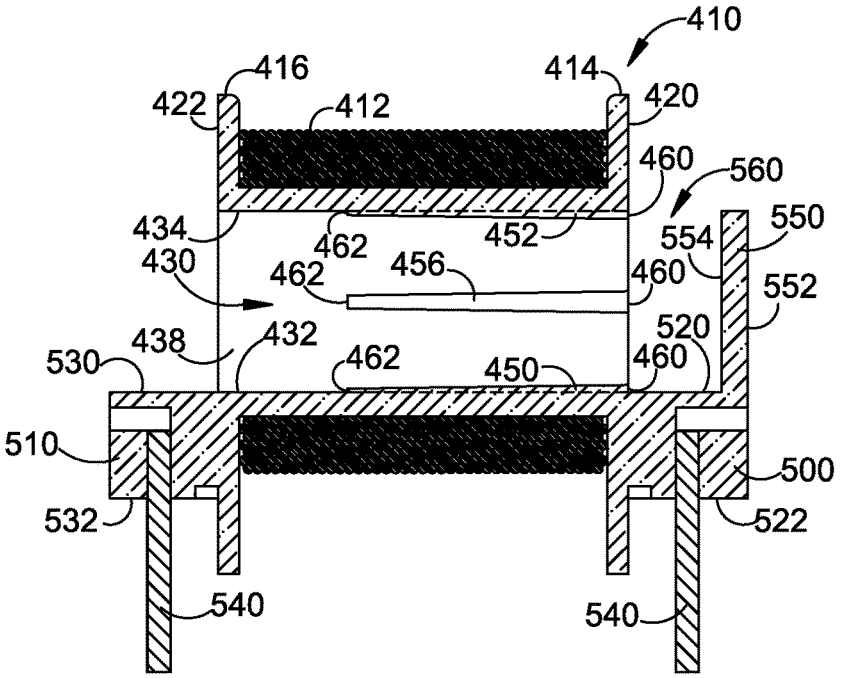
FIG. 12 illustrates a cross-sectional side elevational view of the bobbin of FIG. 6 taken along the line 12-12 in FIG. 6.
Figure 13:
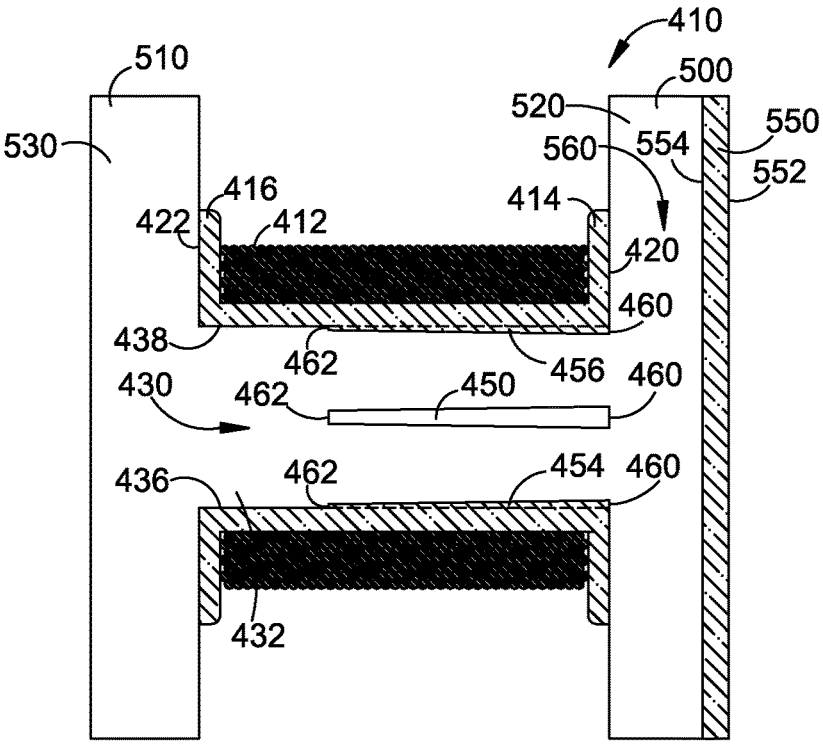
FIG. 13 illustrates a top plan cross-sectional view of the bobbin of FIG. 4 taken along the line 13-13 in FIG. 6.
Figure 14:
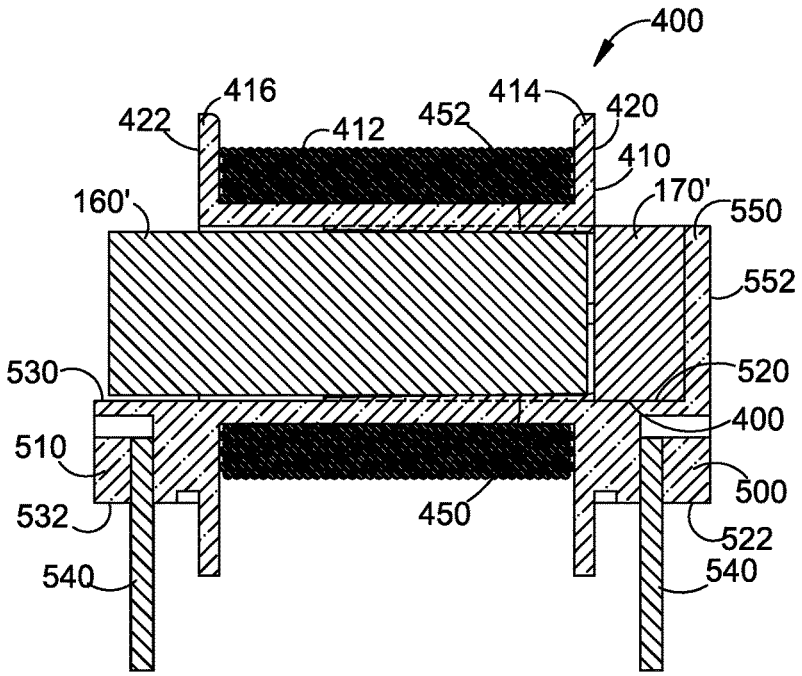
FIG. 14 illustrates a cross-sectional side elevational view of the magnetic assembly of FIG. 4 taken along the line 14-14 in FIG. 4, the view showing the crushing of the top and bottom passageway ribs by the middle leg of the E-core.
Figure 15:
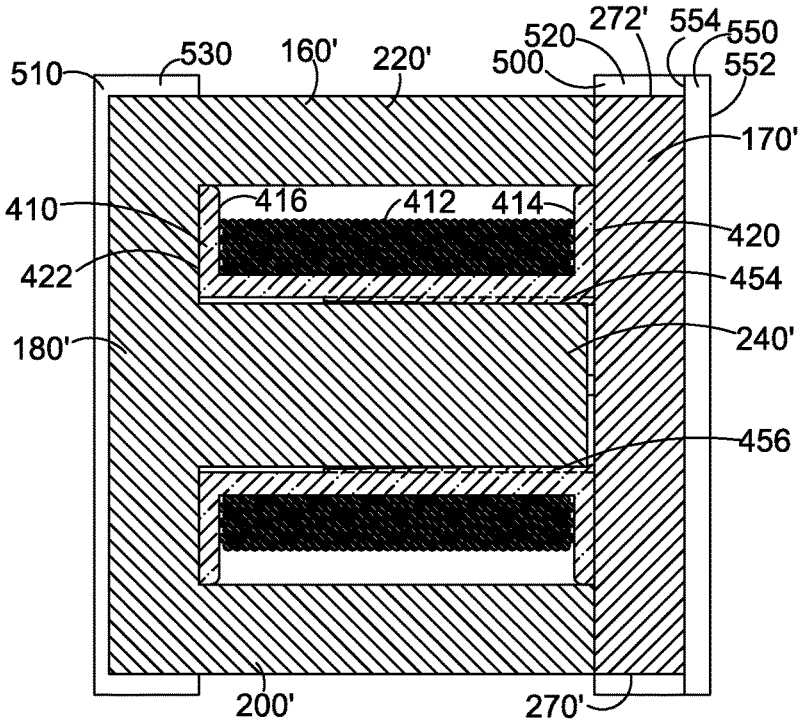
FIG. 15 illustrates a cross-sectional plan view of the magnetic assembly of FIG. 4 taken along the line 15-15 in FIG. 4, the view showing the crushing of the side passageway ribs by the middle leg of the E-core.
Figure 16:
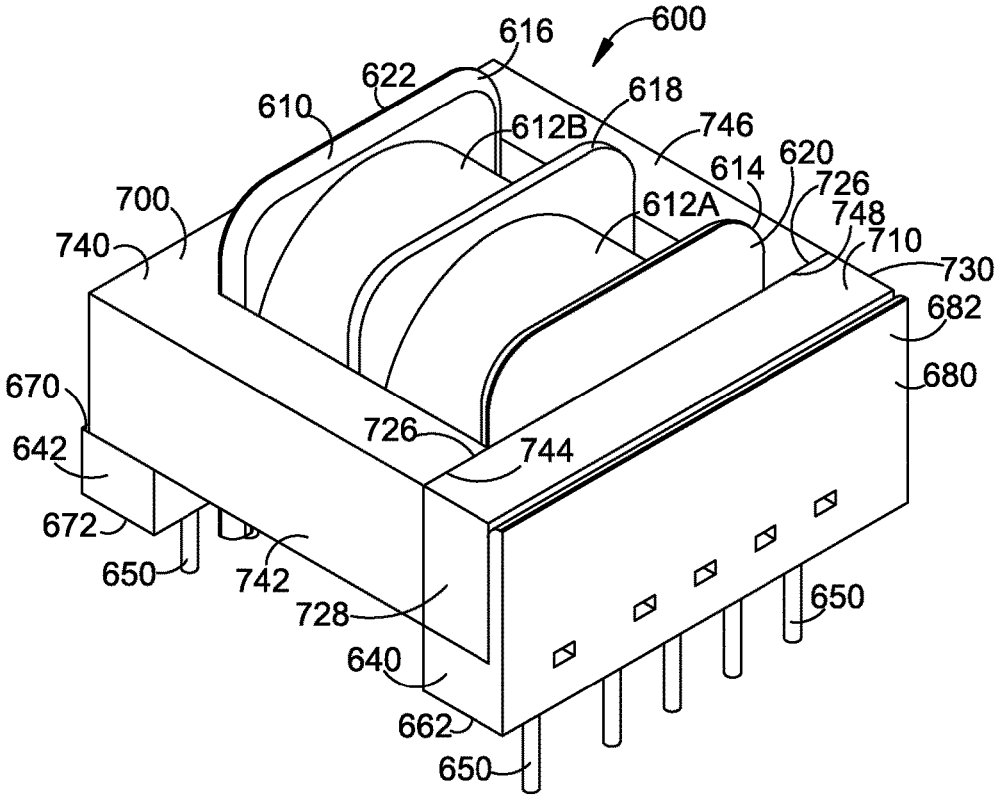
FIG. 16 illustrates a perspective view of a magnetic assembly comprising a bobbin having a cylindrical passageway, an E-core having a middle leg with a circular profile, and an I-core.
Figure 17:
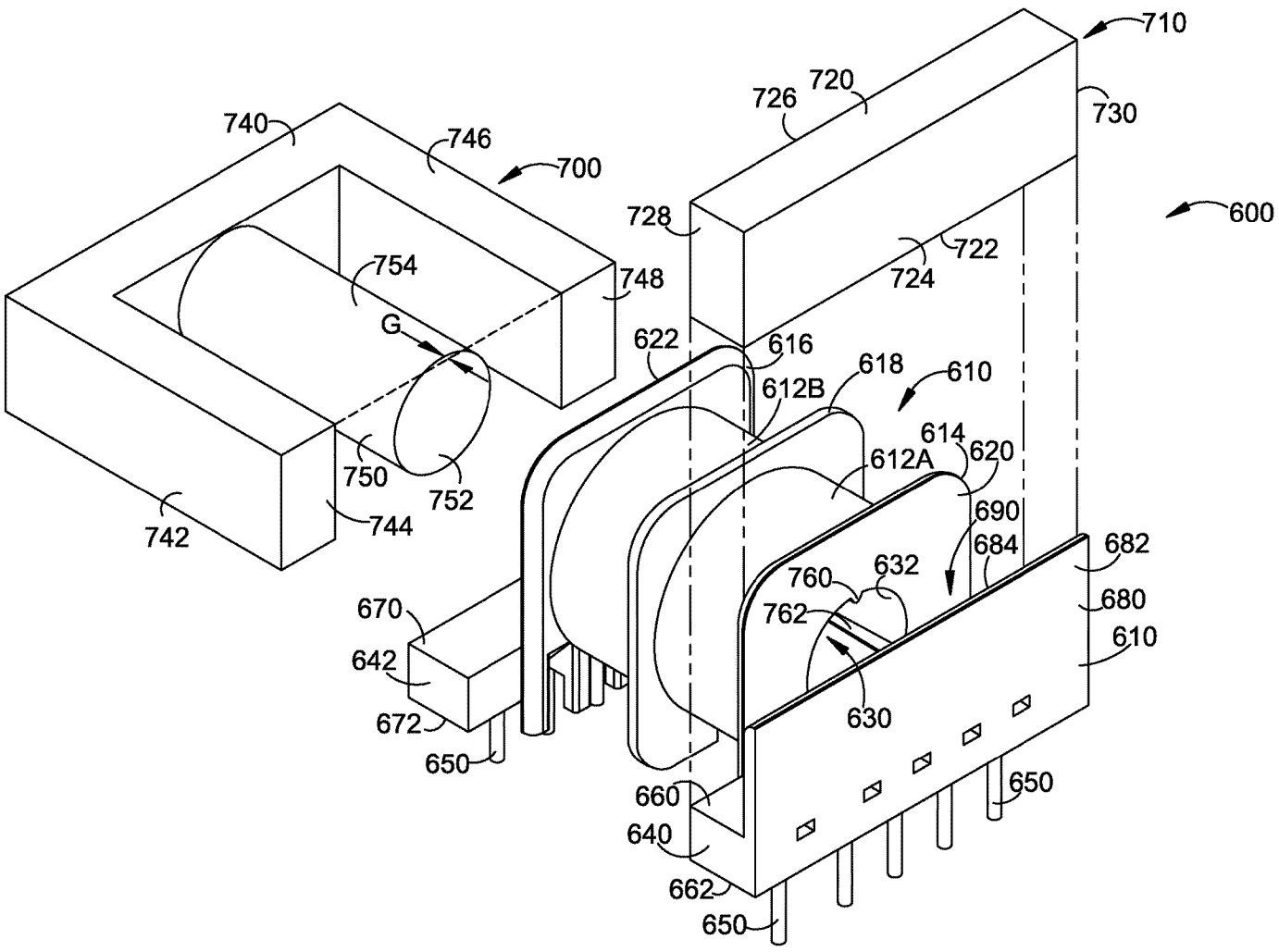
FIG. 17 illustrates an exploded view of the magnetic assembly of FIG. 16.
Figure 18:
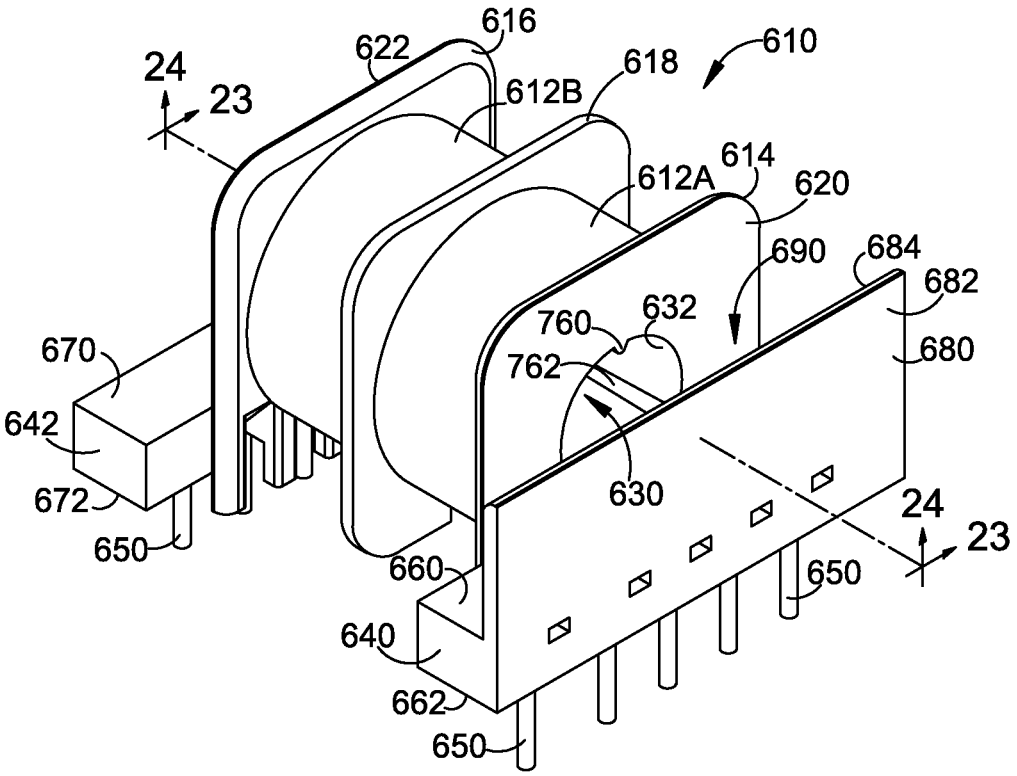
FIG. 18 illustrates a perspective view of the bobbin of FIGS. 16 and 17.

In the illustrated embodiment, each rib 450, 452, 454, 456 extends only part of the way through the passageway 430 from the first end flange 414 toward the second end flange 416 as shown in the cross-sectional elevational view of FIG. 12 and in the cross-sectional plan view of FIG. 13. For example, in the illustrated embodiment, the passageway has a total length of approximately 0.543 inch from the outer surface of the first end flange to the outer surface 422 of the second end flange; and each rib extends approximately 0.3715 inch into the passageway from a respective base end 460 (FIGS. 9 and 10) proximate to the outer surface 420 of the first end flange to a respective terminal end 462 (FIGS. 9 and 11).

Figure 10:
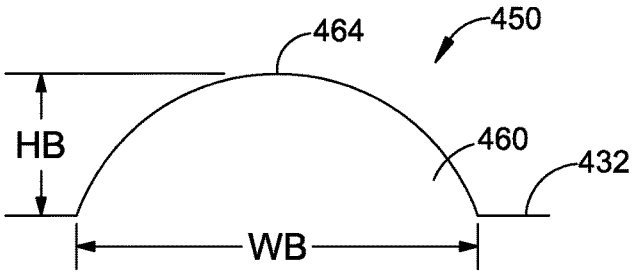
FIG. 10 illustrates an end elevational view of the base end of the passageway rib of FIG. 9.

As shown in an enlarged base end view of the first rib 450 in FIG. 10, the base end 460 of each rib has an arcuate profile that comprises a portion of a semicircular profile. The illustrated arcuate profile of the base end has a radius of approximately 0.015 inch. The base end extends upward from the lower surface 432 of the passageway 430 to a height (HB), which is approximately 0.01 inch in the illustrated embodiment. The base end has a width (WB) along the lower surface of the passageway. The width is approximately 0.028 inch in the illustrated embodiment.

As shown in FIG. 11, the terminal end 462 of each rib also has an arcuate profile. The arcuate profile of the terminal end has a radius of approximately 0.01 inch and has a height (HT) above the lower surface 432 of the passageway 430 such that the terminal end extends approximately 0.005 inch into the passageway. The terminal end has a width (WT) along the lower surface. The width is approximately 0.017 inch in the illustrated embodiment. As shown in FIG. 9, each passageway rib tapers from the respective base end to the respective terminal end at an angle of approximately 0.8 degree. Accordingly, the rib has an inclined engagement surface 664 directed toward the center of the passageway.

As discussed above, the E-core 160' has a height smaller than the height of the previously described E-core 160. For example, in the illustrated embodiment, the middle leg 240' has a square cross-sectional profile with a height and width of approximately 0.224 inch. The passageway 430 also has a square cross-sectional profile, but has a height and width of approximately 0.24 inch. Thus, when centered in the passageway, each of the longitudinal surfaces 242', 244', 250', 252' of the middle leg has a clearance of approximately 0.008 inch with respect to the respective inside surfaces 434, 432, 436, 438 of the passageway. The terminal ends 462 of the ribs 450, 452, 454, 456 extend approximately 0.005 inch into the passageway. Thus, the surfaces of the middle leg have clearances of approximately 0.003 inch with respect to the terminal ends of the ribs. Accordingly, the end surface 260' of the middle leg is easily inserted between the terminal ends of the ribs. In contrast, the base ends 460 of the ribs extend approximately 0.01 inch into the passageway, which exceeds the clearance of 0.008 inch. Thus, the surfaces of the middle leg cannot clear the ribs as the end surface 260' of the middle leg approaches the base ends of the ribs. Rather, as the middle leg is inserted further into the passageway, the longitudinal surfaces of the middle leg engage the engagement surfaces 664 of the passageway ribs and crush the passageway ribs. The crushing of the passageway ribs increases the surface areas of the contacts between the surfaces of the middle leg and the ribs. Accordingly, as shown in the cross-section views of FIGS. 14 and 15, the fully inserted middle leg is frictionally engaged with the passageway ribs such that the middle leg is retained within the passageway and will not disengage from the passageway unless sufficient longitudinal force is applied to overcome the frictional forces. Thus, the modified E-core 160' is retained within the bobbin 410 without requiring taping, gluing or other additional steps.

Although illustrated as one crushable rib 450, 452, 454, 456 on each of four surfaces 432, 434, 436, 438, respectively, of the passageway 430, additional or fewer ribs can be used. For example each surface of the passageway can support two parallel ribs to increase the frictional engagement forces.

The bobbin 410 includes a first connector rail 500 proximate to the first end flange 414 and includes a second connector rail 510 proximate to the second end flange 416. The first connector rail has an upper surface 520 and a lower surface 522. The second connector rail has an upper surface 530 and a lower surface 532. A plurality of connector pins 540 extend downward from the respective connector rails. Selected connector pins are electrically connected to the winding 412.

Figure 3:
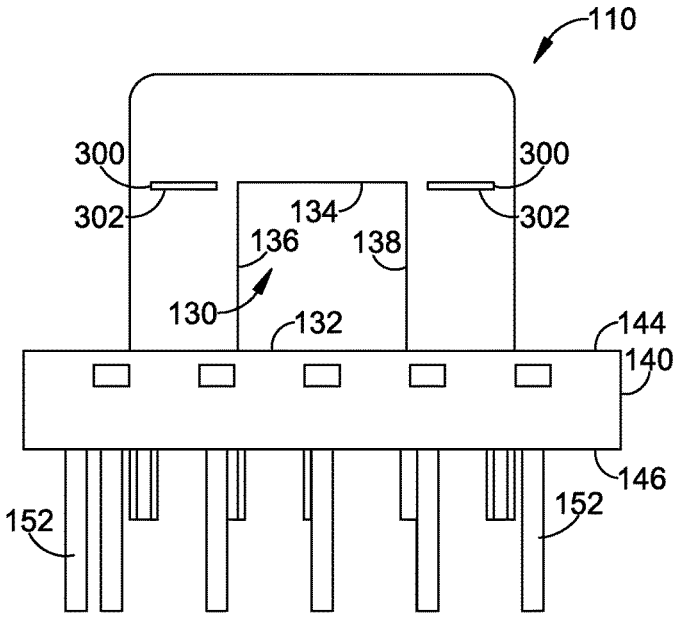
FIG. 3 (Prior Art)
FIG. 3 illustrates a front elevational view of the bobbin of FIG. 2 before installation of the E-core and the I-core.

The second connector rail 510 of the bobbin 410 of FIGS. 4-15 is similar to the previously described second connector rail 142 of the bobbin 110 of FIGS. 1-3.

A lower portion of the first connector rail 500 of the bobbin 410 of FIGS. 4-15 is similar to a corresponding lower portion of the previously described first connector rail 140 of FIGS. 1-3; however, the first connector rail 500 is modified to include a channel wall 550 that extends upward from the upper surface 520 of the first connector rail. In the illustrated embodiment, the channel wall extends to a height above the upper surface that is approximately the same as the height of the I-core 170'. The channel wall has an outer surface 552 that is a continuation of the outer surface of the first connector rail. The channel wall has an inner surface 554 that is spaced apart from the outer surface of the channel wall by a wall thickness. The wall thickness is selected so that the channel wall is substantially rigid and does not bend significantly with respect to the upper surface of the first connector rail. For example, in the illustrated embodiment, the channel wall has a thickness of approximately 0.035 inch. In the illustrated embodiment, the second connector rail 510 extends further from the outer surface 520 of the first end flange 414 to accommodate a portion of the thickness of the channel wall.

The inner surface 554 of the channel wall 550 is spaced apart from the outer surface 420 of the first end flange 414 to form an I-core receiving channel 560 between the two surfaces. The I-core receiving channel has a channel width between the two surfaces selected to be substantially the same as the thickness of the I-core 170' between the outer surface 274' and the inner surface 276' of the I-core. For example, in the illustrated embodiment, the channel width between the two surfaces is approximately 0.123 inch, which corresponds to the thickness of the I-core. The tolerances on the dimensions of the I-core and the channel width are selected such that the outer surface and the inner surface of the I-core frictionally engage the inner surface of the I-core and the outer surface of the first end flange when the I-core is inserted into the I-core receiving channel. Sufficient force is applied to the upper surface 278' of the I-core to overcome the frictional forces between the surfaces of I-core and the surfaces of the I-core receiving channel. After the I-core is fully inserted into the channel with the lower surface 280' of the I-core proximate to the upper surface 520 of the first connector rail 500, the frictional forces retain the I-core in the channel unless sufficient external force is applied to withdraw the I-core. Thus, the I-core is retained within the receiving channel of the bobbin 410 without requiring taping, gluing or other additional steps.

FIGS. 16-24 illustrate a magnetic assembly 600 that incorporates a bobbin 610 having a first winding 612A, a second winding 612B, a first end flange 614, a second end flange 616 and a middle flange 618. The first winding is positioned between the first end flange and the middle flange. The second winding is positioned between the middle flange and the second end flange. The first end flange has an outer surface 620. The second end flange has an outer surface 622. The bobbin has a passageway 630, which extends from the outer surface of the first end flange to the outer surface of the second end flange. The passageway has a circular profile that defines a cylindrical inner surface 632. In the illustrated embodiment, the inner surface has an inside diameter of approximately 0.301 inch.

The bobbin 610 includes a first connector rail 640 and a second connector rail 642. The connector rails support a plurality of connector pins 650. Selected connector pins are electrically connected to the windings 612A, 612B. The first connector rail has an upper surface 660 and a lower surface 662. The second connector rail has an upper surface 670 and a lower surface 672. The first connector rail further includes a channel wall 680 having an outer surface 682 and an inner surface 684. An I-core receiving channel 690 is formed between the inner surface of the channel wall and the outer surface 620 of the first end flange 614.

The magnetic assembly 600 further includes an E-core 700 and an I-core 710. The I-core has an upper surface 720, a lower surface 722, an outer surface 724, an inner surface 726, a first end surface 728 and a second end surface 730. The I-core is positioned in the I-core receiving channel 690 as described above with the outer surface of the I-core against the inner surface 684 of the channel wall 680 and with the inner surface of the I-core against the outer surface 620 of the first end flange 614. The lower surface of the I-core is positioned proximate to the upper surface 660 of the first connector rail 640.

The E-core 700 has a body portion 740. A first outer leg 742, having an end surface 744, and a second outer leg 746, having an end surface 748, extend from the body portion. A middle leg 750, having an end surface 752 and a longitudinal outer surface 754, extends from the body portion between the two outer legs. The two outer legs correspond to the outer legs of the previously described E-cores 160, 160' and have rectangular cross-sectional profiles as shown. The middle leg has a circular cross-sectional profile that is similar to, but slightly smaller than, the circular profile of the passageway 630 of the bobbin 610. For example, in the illustrated embodiment, the middle leg has an outside diameter of 0.29 inch compared to the 0.301-inch inside diameter of the passageway. Thus, the cylindrical outer surface of the middle leg has a nominal clearance of approximately 0.0055 inch when centered in the passageway. In the illustrated embodiment, the diameter of the circular profile of the middle leg is also slightly smaller than the heights of the two outer legs. The middle leg is shorter than the two outer legs such the end surface of the middle leg is offset from the end surfaces of the outer legs by the gap distance (G) as described above.

Figure 19:
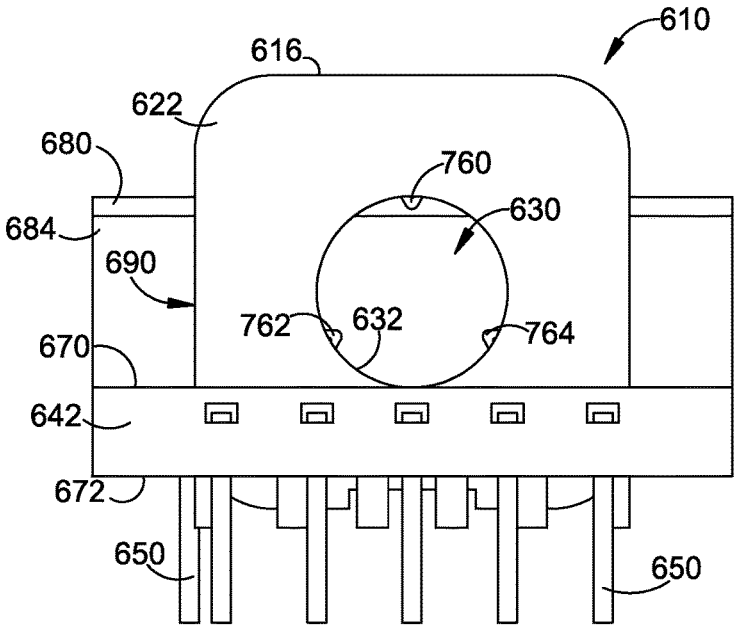
FIG. 19 illustrates an elevational end view of the bobbin of FIG. 18 showing the pattern of passageway ribs within the cylindrical passageway.

The passageway 630 of the bobbin 610 includes a plurality of crushable passageway ribs that extend longitudinally from the first end flange 614 toward the second end flange 616 as described above for the bobbin 410. The ribs extend radially inward from the cylindrical inner surface 632 of the passageway. As shown in FIG. 19, the passageway includes an uppermost first rib 760, a second rib 762 and a third rib 764. The three ribs are spaced apart from each other around the inner surface of the passageway by 120 degrees with respect to the middle of the circular profile of the passageway.

Figure 20:
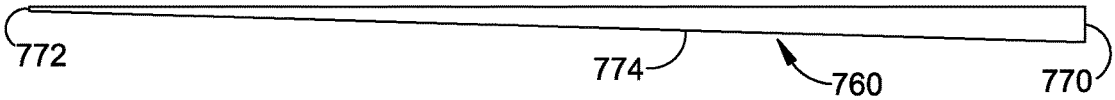
FIG. 20 illustrates an enlarged elevational view of the uppermost passageway rib in FIG. 19.
Figure 21:
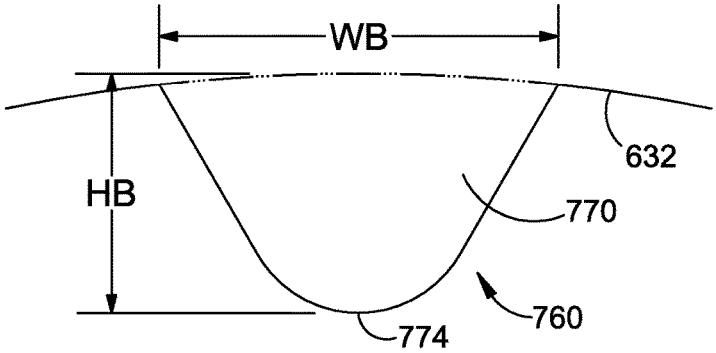
FIG. 21 illustrates an elevational end view of the base end of the passageway rib of FIG. 20.
Figure 22:
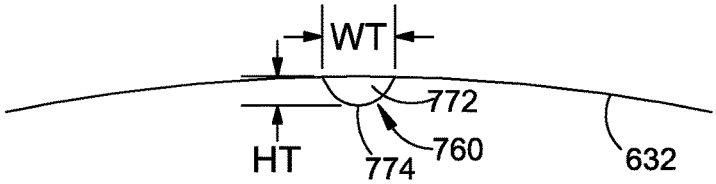
FIG. 22 illustrates an elevational end view of the terminal end of the passageway rib of FIG. 20.
Figure 23:
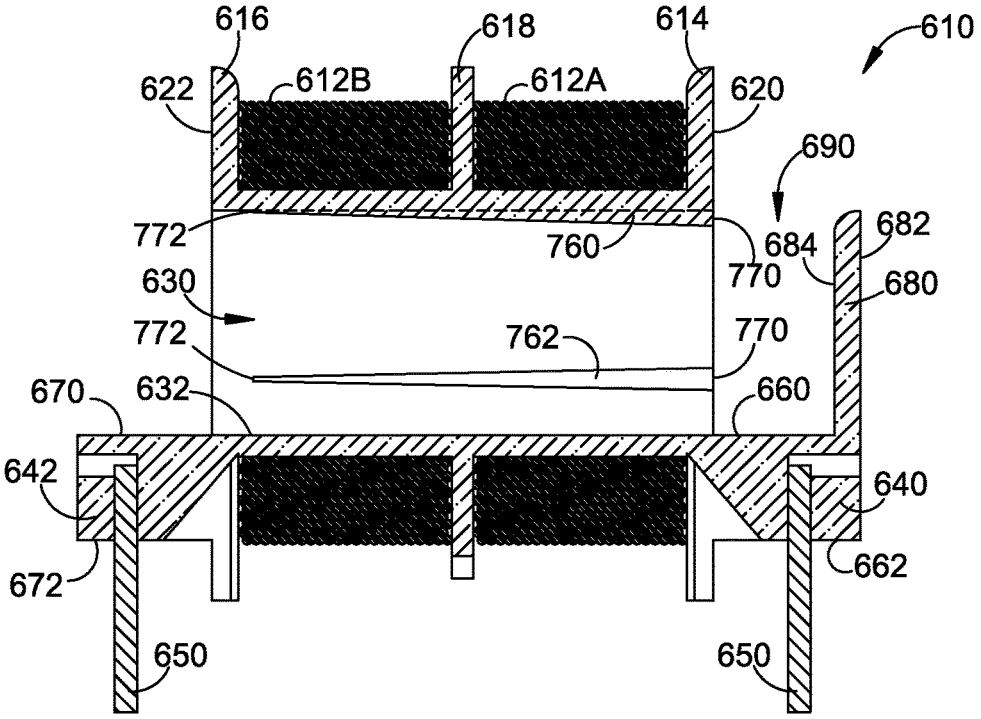
FIG. 23 illustrates a cross-sectional elevational view of the bobbin of FIG. 18 taken along the line 23-23 in FIG. 18.
Figure 24:
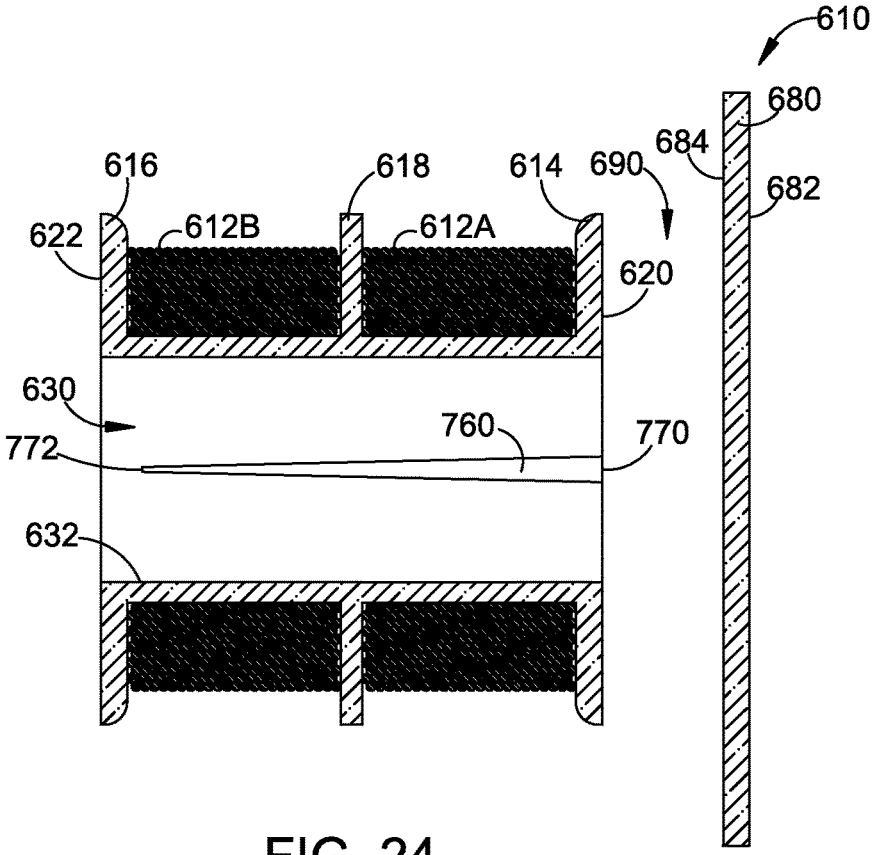
FIG. 24 illustrates a cross-sectional plan view of the bobbin of FIG. 18 taken along the line 24-24 in FIG. 18 looking upward toward the top of the cylindrical passageway.

Each of the passageway ribs 760, 762, 764 may have the configuration described above for the passageway ribs 450, 452, 454, 456 of the previous embodiment; however, in the illustrated embodiment, each passageway rib of the bobbin 610 has a configuration shown in FIGS. 20-22 for the uppermost rib 760. The other ribs 762, 764 have a corresponding configuration. Each rib extends from a respective base end 770 at the outer surface 620 of the first flange 614 toward the second flange 616. As shown in FIGS. 23 and 24, a terminal end 772 of each rib is spaced apart from the respective base end by a distance selected so that the rib extends longitudinally for part of the length of the passageway 630. In the illustrated example, the passageway has a length of approximately 0.67 inch, and the rib has a length of approximately 0.615 inch from the base end to the terminal end.

As shown in FIG. 21, the base end 770 of the rib 760 has a profile of an equilateral triangle with the top vertex of the triangular profile replaced with an arcuate curve. The arcuate curve at the vertex of the profile of the base end of the rib has a radius of 0.01 inch. In the illustrated embodiment, the profile of the base end of the rib has a base width (WB) of approximately 0.034 inch and a height (HB) of approximately 0.021 inch with respect to the inner surface 632 of the passageway 630. The arcuate phantom line at the base of the rib is a continuation of the circular profile of the passageway where the rib intersects the passageway at the outer surface 620 of the first end flange 614.

As shown in FIG. 22, the terminal end 772 of the rib 760 also has a profile of an equilateral triangle with the top vertex of the triangular profile replaced with an arcuate curve. The arcuate curve at the vertex of the triangular profile of the terminal end of the rib has a radius of 0.003 inch. In the illustrated embodiment, the triangular profile has a base width (WT) of approximately 0.006 inch and a height (HT) of approximately 0.002 inch with respect to the inner surface 632 of the passageway 630.

In the illustrated embodiment, the height of the rib 760 with respect to the inner surface 632 of the passageway 630 tapers from the base end 770 to the terminal end 772 at an angle of approximately 1.68 degrees. Accordingly, the rib has an inclined engagement surface 774 directed toward the center of the passageway.

The magnetic assembly 600 of FIGS. 16-24 is assembled as described above for the magnetic assembly 400. The I-core 710 is inserted into the I-core receiving channel 690 and is secured therein by the frictional engagement of the channel surfaces with the surfaces of the I-core. In particular, the inner surface 684 of the channel wall 680 is frictionally engaged with the outer surface 724 of the I-core, and the outer surface 620 of first end flange 614 is frictionally engaged with the inner surface 724 of the I-core.

The middle leg 750 of the E-core 700 is inserted into the passageway 630 of the bobbin 610. As discussed above, the longitudinal outer surface 754 of the middle leg has a nominal clearance of approximately 0.0055 inch with respect to the inside surface 632 of the passageway. The terminal ends 770 of the three passageway ribs 760, 762, 766 extend approximately 0.002 inch into the passageway. Thus, the end surface 752 of the middle leg clears the terminal ends. However, the end surface of the middle leg cannot clear the base ends 772 of the ribs, which extend 0.021 inch into the passageway. As the middle leg is advanced into the passageway, the outer surface of the middle leg initially engages the engagement surfaces 774 of the ribs, which causes the middle leg to be centered in the passageway. As the middle leg is inserted further into the passageway, the outer surface of the middle leg crushes the passageway ribs to frictionally engage the middle leg with the passageway rib. The frictional engagement secures the middle leg within the passageway. Accordingly, the magnetic assembly of FIGS. 16-24 does not require taping, gluing or other additional steps to maintain the assembly in the assembled configuration shown in FIG. 16.

The foregoing features can be incorporated into other magnetic assemblies having I-core and various configurations of E-cores. For example, the passageway and the passageway ribs can be adapted to receive a middle leg having an oval (e.g., racetrack-shaped) profile. Such a profile can be oriented to form a low-profile magnetic assembly. The length of the passageway can be extended or shortened to accommodate E-cores having longer or shorter middle legs.

Although there have been described particular embodiments of the present invention of a new and useful "Bobbin and Core Assembly Configuration and Method for E-Core and I-Core Combination," it is not intended that such references be construed as limitations upon the scope of this invention except as set forth in the following claims.

What is claimed is:

1. A magnetic assembly comprising:

a bobbin comprising a first end flange and a second end flange, each end flange having a respective outer surface, a passageway extending through the bobbin from the first end flange to the second end flange, the passageway having a passageway height, the passageway including a plurality of crushable passageway ribs extending longitudinally from the first end flange toward the second end flange, and at least one winding wound about the passageway, the bobbin further comprising a channel wall parallel to the outer surface of the first end flange, the channel wall having an inner surface, the inner surface of the channel wall displaced from the outer surface of the first end flange to define an I-core receiving channel between the outer surface of the first end flange and the inner surface of the channel wall, the inner surface of the channel wall having a channel wall height approximately equal to the passageway height, the I-core receiving channel having a channel width between the outer surface of the first end flange and the inner surface of the channel wall, the I-core receiving channel extending longitudinally and vertically with respect to the outer surface of the first end flange;

an E-core having a main body with an inner surface, and having a first outer leg, a second outer leg, and a middle leg extending from the inner surface of the main body, each of the first outer leg, the second outer leg and the middle leg having a respective end surface displaced away from the inner surface of the main body, the middle leg of the E-core positioned in the passageway of the bobbin with at least a portion of the middle leg in crushing frictional engagement with the passageway ribs, the inner surface of the main body positioned against the outer surface of the second end flange, the respective end surfaces of the first outer leg and the second outer leg substantially flush with the outer surface of the first end flange; and an I-core in the form of a rectangular parallelepiped, the I-core having a first longitudinal surface and a second longitudinal surface defining a thickness of the I-core therebetween, the thickness of the I-core substantially equal to the channel width, the I-core positioned in the I-core receiving channel with the first longitudinal surface in frictional engagement with the outer surface of the first end flange and with the second longitudinal surface in frictional engagement with the inner surface of the channel wall, the frictional engagement of the first longitudinal surface with the outer surface of the first end flange and the frictional engagement of the second longitudinal surface with the inner surface of the channel wall sufficient to retain the I-core in a fixed position, both longitudinally and vertically, within the I-core receiving channel.

2. The magnetic assembly as defined in claim 1, wherein each passageway rib has a first thickness at a first end proximate to the first end flange and has a second thickness at a second end displaced away from the first end flange, the second thickness less than the first thickness, the crushable rib having an engagement surface between the first end and the second end, the engagement surface frictionally engaging the middle leg of the E-core.

3. The magnetic assembly as defined in claim 1, wherein:

the passageway of the bobbin has a cross-sectional profile defined by at least one inner dimension;

the middle leg of the E-core has a profile defined by at least one outer dimension, the at least one outer dimension smaller than the at least one inner dimension by a selected magnitude so that the middle leg fits within the passageway; and at least a portion of each passageway rib extends into the passageway by a distance greater than the selected magnitude so that the middle leg of the E-core engages and crushes the at least a portion of each passageway rib.

4. The magnetic assembly as defined in claim 3, wherein each crushable rib tapers from a first height at a first end proximate to the first end flange, the first height greater than the selected magnitude, to a second height at a second end displaced away from the first end flange, the second height less than the selected magnitude.

5. The magnetic assembly as defined in claim 1, wherein the passageway of the bobbin has a rectangular cross-sectional profile having four sides, and wherein the middle leg of the E-core has a rectangular cross-sectional profile.

6. The magnetic assembly as defined in claim 5, wherein the plurality of crushable passageway ribs includes four ribs, with one rib extending into the passageway from each side of the passageway.

7. The magnetic assembly of claim 1, wherein the passageway of the bobbin has a circular cross-sectional profile, and wherein the middle leg of the E-core has a circular rectangular profile.

8. The magnetic assembly of claim 7, wherein the plurality of crushable passageway ribs includes three ribs, with the ribs positioned 120 degrees apart around the inside surface of the passageway.

9. The magnetic assembly of claim 1, wherein the middle leg of the E-core is shorter than the two outer legs of the E-core by a selected distance, and wherein the end surfaces of the outer legs abut the first longitudinal surface of the I-core such that the end surface of the middle leg is spaced apart from the first longitudinal surface of the I-core by the selected distance to form a magnetic gap between the middle leg and the I-core.

10. A bobbin for a magnetic assembly that includes an E-core and an I-core, the E-core including a main body with a first outer leg, a second outer leg and a middle leg extending from the main body, each of the first and second outer legs having a common outer leg length from the main body to a respective outer leg end surface, the middle leg having a middle leg length shorter than the common outer leg length, the I-core formed as a rectangular parallelepiped having a first side surface and a second side surface, the I-core having an I-core thickness between the first side surface and the second side surface, the bobbin comprising:

a first end flange having a first end flange outer surface;

a second end flange having a second end flange outer surface;

a passageway extending through the bobbin from the first end flange to the second end flange, the passageway including a plurality of crushable passageway ribs extending from the first end flange toward the second end flange, the passageway having a passageway length from the first end flange outer surface to the second end flange outer surface substantially equal to the common outer leg length, the passageway having a passageway height;

at least one winding wound about the passageway; and a channel wall parallel to the first end flange outer surface, the channel wall having an inner surface, the inner surface of the channel wall displaced from the first end flange outer surface to define an I-core receiving channel between the first end flange outer surface and the inner surface of the channel wall, the inner surface of the channel wall having a wall height approximately equal to the passageway height, the I-core receiving channel having a channel width between the first end flange outer surface and the inner surface of the channel wall, the channel width configured to be no greater than the I-core thickness such that the first end flange outer surface and the inner surface of the channel wall frictionally engage the first side surface and the second side surface, respectively, of the I-core to fixedly position the I-core within the I-core receiving channel.

11. The bobbin as defined in claim 10, wherein each crushable rib tapers from a first height at a first end proximate to the first end flange to a second height at a second end displaced away from the first end flange.

12. A method of assembling a magnetic assembly comprising:

positioning the middle leg of an E-core into a passageway of a bobbin with a first outer leg of the E-core positioned on a first side of the bobbin, with a second outer leg of the E-core positioned on a second side of the bobbin, and with a main body of the E-core positioned on a terminal rail at a first end of the bobbin, the middle leg crushing and frictionally engaging a plurality of crushable ribs extending longitudinally within the passageway to secure the middle leg in the passageway, the passageway having a passageway height; and positioning an I-core into an I-core receiving channel at a second end of the bobbin, the I-core having a first longitudinal surface and a second longitudinal surface defining a thickness of the I-core therebetween, the thickness of the I-core substantially equal to a width of the I-core receiving channel, the I-core positioned in the I-core receiving channel with the first longitudinal surface in frictional engagement with the outer surface of the first end flange and with the second longitudinal surface in frictional engagement with the inner surface of the channel wall, the frictional engagement of the first longitudinal surface with the outer surface of the first end flange and the frictional engagement of the second longitudinal surface with the inner surface of the channel wall sufficient to retain the I-core in a fixed position, both longitudinally and vertically, within the I-core receiving channel, the I-core receiving channel having a channel wall height approximately equal to the passageway height.

13. The method of assembling a magnetic assembly as defined in claim 12, wherein one of the first and second longitudinal surfaces of the I-core is spaced apart from an end of the middle leg of the E-core to form a magnetic gap.

* * * * *